United States Patent [19]

Ishii

[11] 4,361,067

[45] Nov. 30, 1982

[54] ELECTRONIC MUSICAL INSTRUMENT WITH KEYBOARD

[75] Inventor: Hiroshi Ishii, Tachikawa, Japan

[73] Assignee: Casio Computer Co., Ltd., Tokyo, Japan

[21] Appl. No.: 213,089

[22] Filed: Dec. 4, 1980

[30] Foreign Application Priority Data

Dec. 19, 1979 [JP] Japan ..... 54-165266

[51] Int. Cl.[3] ..... G10H 1/02

[52] U.S. Cl. ..... 84/1.27; 84/1.03

[58] Field of Search ..... 84/1.03, 1.26, 1.27, 84/1.13, 1.1, 1.19, 1.01

[56] References Cited

U.S. PATENT DOCUMENTS

| | | | |
|---|---|---|---|
| 3,956,960 | 5/1976 | Deutsch | 84/1.19 |
| 4,022,097 | 5/1977 | Strangio | 84/1.03 |
| 4,067,253 | 1/1978 | Wheelwright et al. | 84/1.1 |
| 4,108,039 | 8/1978 | Deutsch | 84/1.19 |
| 4,129,055 | 12/1978 | Whittington et al. | 84/DIG. 22 |
| 4,147,083 | 4/1979 | Woron et al. | 84/1.03 |
| 4,149,440 | 4/1979 | Deforeit | 84/1.01 |
| 4,244,260 | 1/1981 | Kniepkamp et al. | 84/1.27 |

*Primary Examiner*—J. V. Truhe
*Assistant Examiner*—Forester W. Isen
*Attorney, Agent, or Firm*—Frishauf, Holtz, Goodman and Woodward

[57] ABSTRACT

Predetermined keys in a keyboard are used as reading keys for specifying the reading of note codes memorized in a memory section under the control of a function changing switch. Sounds corresponding to the note codes memorized in the memory section are delivered from a loudspeaker with a plurality of different volume levels set in the order of arrangement of the keys set as the reading specification keys.

10 Claims, 6 Drawing Figures

FROM KEY INPUT SECTION 10
10a
10b
10c
10d
KEY-ON DETECTING CKT. 404
404a
404b
405
COUNTER 402
COUNTER 401
403
φ A
MEMORY 415
MEMORY 414
413
411
406
408
407
409
412
SHIFT REGISTER
410
NORMAL
DIV
WRITE
READ
V
5a
419
420
421
S Q
R
418
S Q Q̄
R
417a
417b
416f
416e
416d
416c
416b
416a
425
422
423
424
426
427
A
B
C
D
E
430a
430b
430c
430d
428
428a
COUNTER 429

ELECTRONIC MUSICAL INSTRUMENT WITH KEYBOARD

BACKGROUND OF THE INVENTION

This invention relates to electronic musical instruments a with keyboard and, more particularly, an electronic keyboard musical instrument which has a memory section for previously memorizing the content of performance of a piece of music and has a function of reproducing the memorized performance content in the memory section by operating certain keys of the keyboard as reading instruction keys.

In playing an electronic instrument a with keyboard, it is usual to produce a melody using the right hand and to produce an accompaniment with the left hand. However, since the melody and accompaniment often differ in rhythm, the performance is very difficult for beginners.

Accordingly, it has been in practice to previously memorize, for instance, the accompaniment and play the instrument for producing the melody alone timed to the automatic reproduction of the memorized accompaniment. Also, it has been contemplated to memorize the melody and play the instrument for producing the accompaniment timed to the automatic reproduction of the memorized melody.

However, with the prior-art electronic keyboard musical instrument, the reproduced music is fixed in volume level and lacks variation, so that it is inferior in the musical sense to an actual performance where the melody and accompaniment are produced with the right and left hand respectively.

An object of the invention is to provide an electronic musical instrument with a keyboard, which has a memory section for previously memorizing a performance content of a piece of music, and in which the memorized performance content is reproduced by using predetermined keys in the keyboard as reading instruction keys to which different reproduction volume levels are alloted.

SUMMARY OF THE INVENTION

This object of the invention is achieved by an electronic keyboard musical instrument comprising a keyboard having a plurality of performance keys, a memory means for previously memorizing pitch codes corresponding to a series of tones, a means for setting predetermined performance keys in the keyboard as pitch code reading instruction keys for reproducing tones of the memorized pitch codes, and a means for setting different volume levels to reproduced tones in the order of arrangement of the performance keys set as the reading instruction keys.

DETAILED DESCRIPTION

Figure 1:
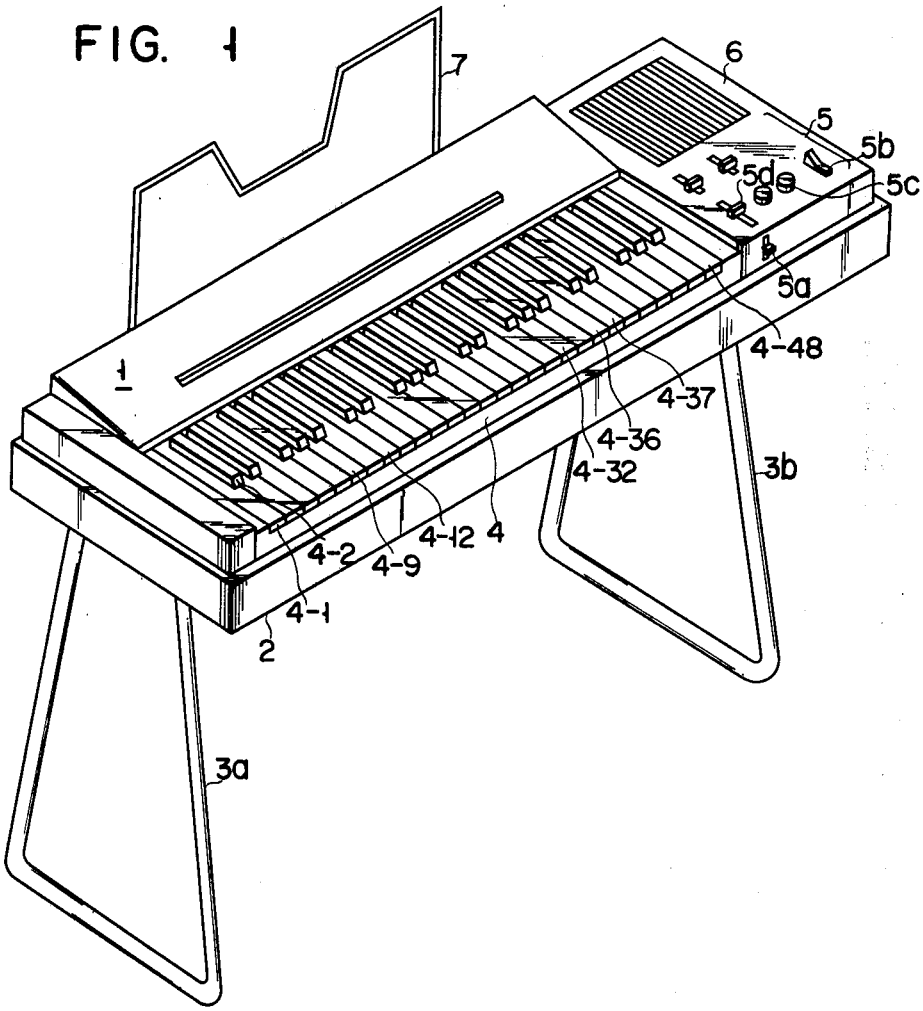
FIG. 1 is a perspective view showing an embodiment of the electronic keyboard musical instrument according to the invention.

Referring to FIG. 1, an electronic keyboard musical instrument 1 comprises an instrument body 2 and support legs 3*a* and 3*b*. The instrument body 2 has a keyboard 4, an operation section 5, a loudspeaker 6 and a music stand 7. The keyboard has 48 performance keys 4–1, 4–2, . . . , 4–48 covering four octaves, with the key 4–1 set to pitch $C_2$ and the key 4–48 set to pitch $B_5$. In the following description, the keys 4–37 to 4–48 which respectively correspond to $C_5$ to $B_5$ can serve as previously memorized performance content reading instruction keys as well as the performance keys. Their functions as performance keys and as reading instruction keys are switched by operating an operation mode selection switch 5*a* provided in the operation section 5, as will be described hereinafter in detail. The operation section 5 has, in addition to the switch 5*a*, a power switch 5*b*, a volume control knob 5*c*, a tone colour selection switch 5*d*, etc.

Figure 2A:
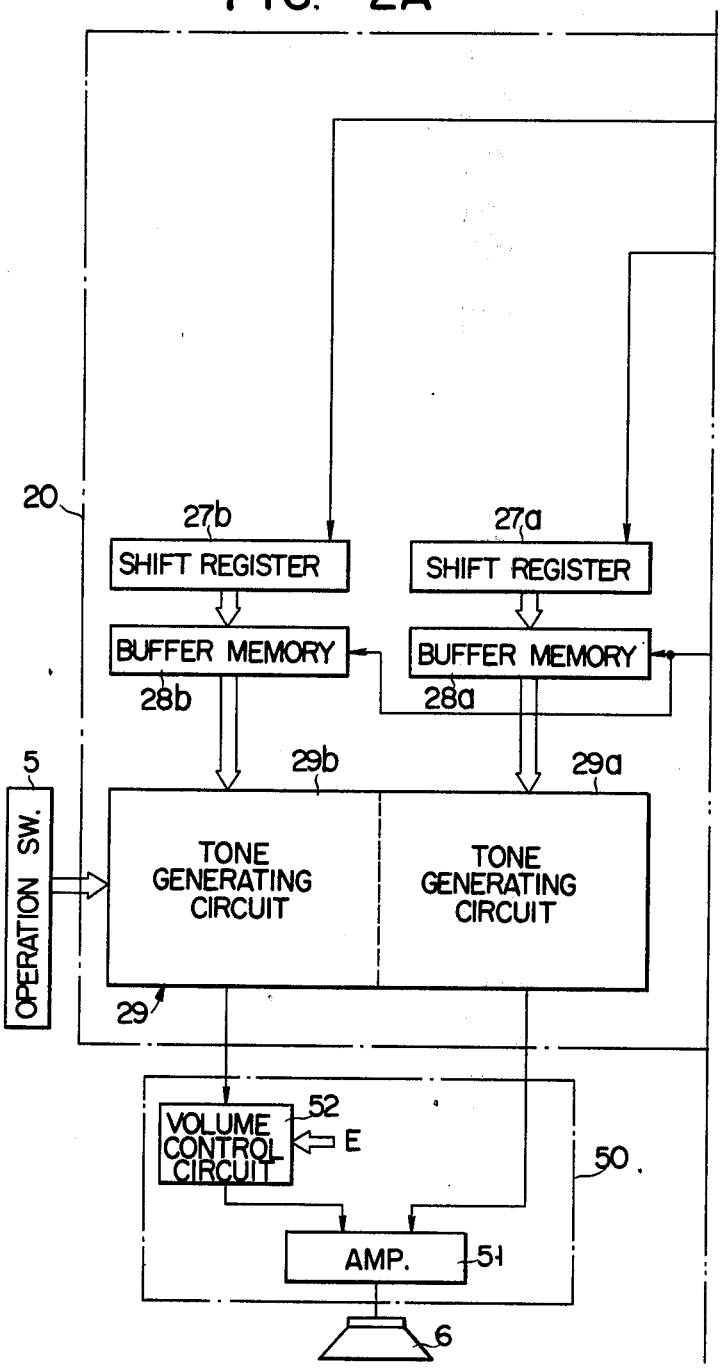
FIGS. 2A and 2B show a schematic representation of the circuit of the same embodiment.
Figure 2B:
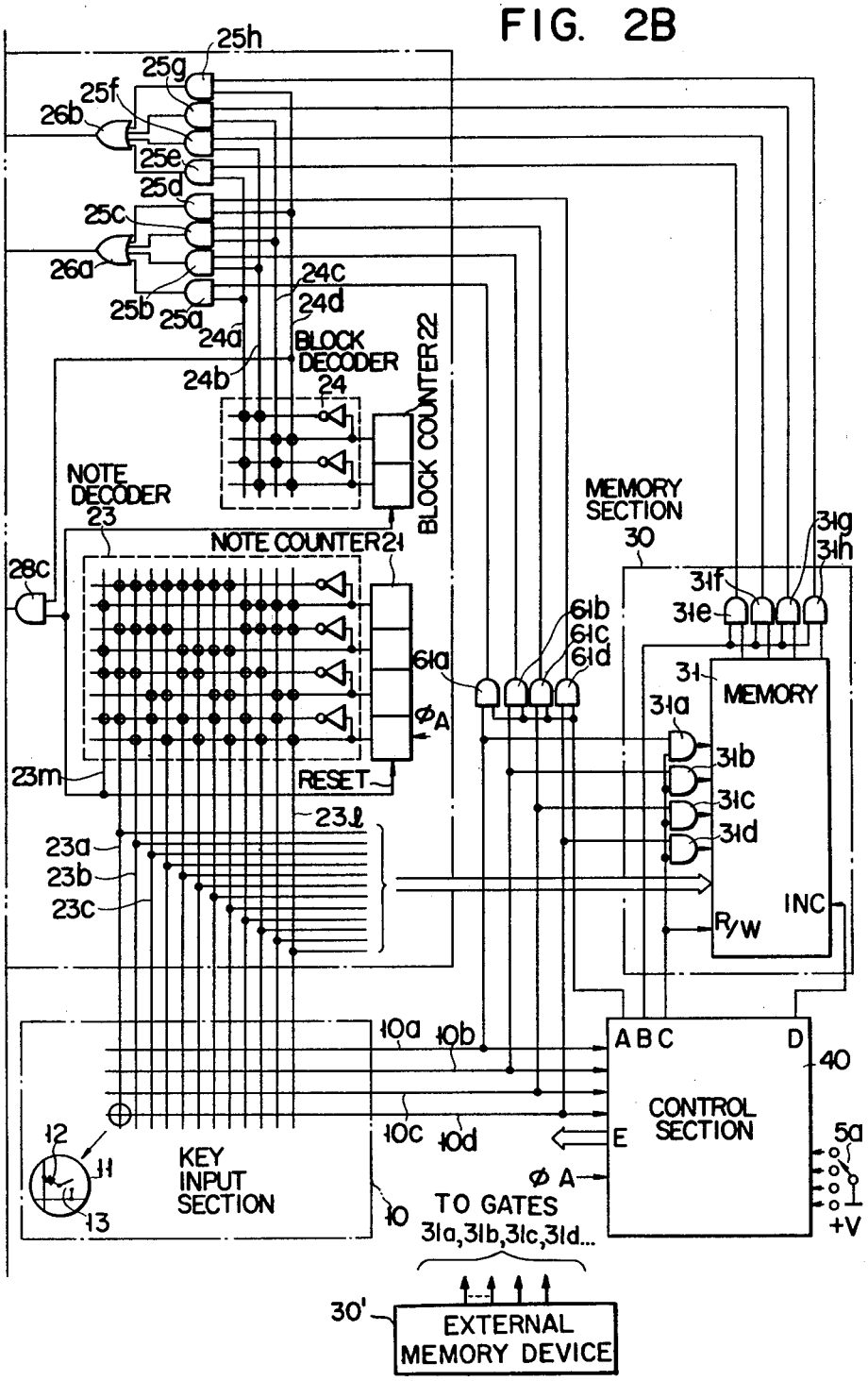

FIGS. 2A and 2B show the circuit construction of this embodiment. The circuit consists of five circuit blocks and leads connecting these blocks to one another. These circuit blocks each consist of an LSI (large scale integrated circuit) or a hybrid IC. The circuit block 10 is a key input section coupled to the individual keys in the keyboard 4, the circuit block 20 is a musical sound generating section including tone generating circuits and a key input control circuit, the circuit block 30 is a memory section including a memory 31, in which scale codes are preset, and peripheral circuits, the circuit block 40 is a control section for instructing the writing in the memory section 30 and reading therefrom, and the circuit block 50 is an acoustic converter section. The memory 31 consists of a semi-conductor memory such as a RAM (random access memory).

The, the circuit blocks 10 to 50 and their connection are described hereinbelow. The musical sound generating section 20 includes a 4-bit note counter 21 for scanning the keyboard 4 to detect a depressed performance key and a 2-bit block counter 22. A clock signal $\phi_A$ for scanning is supplied to the first bit of the note counter 21. The count content of the note counter 21 is coupled to a note decoder 23, which scans like note keys in the individual octaves of the key input section 10 by producing a "1" signal at different timings to 12 lines 23*a* to 23*l* for respective 12 notes C to B according to the count values "0" to "11" of the note counter 21. The note decoder 23 also has a line 23*m*, in which an output is obtained when the count value of the note counter 21 becomes "12", and this output is coupled as a reset signal to the note counter 21 and also coupled as a count clock signal to the block counter 22. The block counter 22 counts the count signal mentioned above, and its count content is coupled to a decoder 24. The block decoder 24 produces a "1" signal to lines 24*a* to 24*d* at different timings according to the count values "0" to "3" of the block counter 22, and the signals supplied to these lines 24*a* to 24*d* are coupled as an octave detection signal to AND gates 25*a* to 25*d* at one input terminal thereof and also to AND gates 25*e* to 25*h* at one input terminal thereof. The outputs of the AND gates 25*a* to 25*d* are coupled through an OR gate 26*a* to a shift register 27*a*, which has a function of serial-to-parallel conversion and also has a capacity of 48 bits corresponding to the number of keys in the key input section 10, and the outputs of the AND gates 25*e* to 25*h* are coupled through an OR gate 26*b* to a similar shift register 27*b*. The shift registers 27*a* and 27*b* each have bit positions peculiar to the respective keys in the key input section 10 and memorize data with respect to these keys, and their parallel outputs are coupled to respective buffer memories 28*a* and 28*b* individually having the same 48-bit capacity as the shift registers 27*a* and 27*b*. The buffer memories 28*a* and 28*b* read out the contents of the shift registers 27*a* and 27*b* when the scanning of all the keys in the key input section 10 is ended in response to a read signal, which is the output of an AND gate 28*c* to which the signals from the line 23*m* of the note decoder 23 and the line 24*d* of the block decoder 24 are coupled. The outputs of the buffer memories 28*a* and 28*b* are coupled to respective tone generating circuits 29*a* and 29*b*, in which various tone signals are produced digitally according to the notes of operated keys. These tone generating circuits 29*a* and 29*b* produce tone signals in two different systems respectively according to the signals from the buffer memories 28*a* and 28*b*. While in this embodiment the two tone generating circuits 29*a* and 29*b* are provided for the respective buffer memories 28*a* and 28*b*, it is also possible to obtain the tone signals in the two different systems by driving a single tone generating circuit on a time division basis. The digital tone signals produced within the tone generating circuits 29*a* and 29*b* are converted into analog signals by digital-to-analog converters within the circuits 29*a* and 29*b*. Of these analog signal outputs, the output from the circuit 29*a* is directly coupled to an amplifier 51 within the acoustic converter section 50, while the output of the circuit 29*b* is coupled to a volume control circuit 52 for volume control therein according to a volume control signal E (to be described later) coupled from the control section 40 before it is coupled to the amplifier 51. The volume control circuit 52 includes a digital-to-analog converter for converting the aforementioned signal E (which is a 4-bit digital signal) into an analog signal and a VCA (voltage controlled amplifier) for receiving the output of the digital-to-analog converter and effecting the volume control. The tone signal inputs to the amplifier 51 are amplified therein and are then coupled to a loudspeaker 6 for musical sound generation.

An output from the operation section 5, produced with the operation of a switch or a knob therein, is also coupled to the tone generating circuits 29*a* and 29*b*, and these circuits 29*a* and 29*b* thus produce given tone signals according to the outputs of the resepective buffer memories 28*a* and 28*b* and the output of the operation section 5.

The key input section 10 has a matrix constituted by four row lines and 12 column lines with 48 switches corresponding to the respective keys for four octaves in the keyboard 4 and provided each at each intersection. A typical intersection is shown in detail within a circle 11. As is shown, a diode 12 and a switch 13 are coupled to a key and are connected in the illustrated manner. The individual column lines in the key input section 10 are connected to the respective lines 23*a* to 23*l* of the note decoder 23. Like keys for different octaves are connected in the individual columns, and keys for respective 12 notes C to B are connected in each row. Key operation outputs from the individual row lines are coupled to respective lines 10*a* to 10*d* at the timings of the individual notes in each row.

The key operation signals coupled to the lines 10*a* to 10*d* are coupled to respective AND gates 61*a* to 61*d* at one input terminal thereof, and the outputs thereof are coupled to the other input terminals of the respective AND gates 25*a* to 25*d*.

The key operation signals coupled to the lines 10*a* to 10*d* are also coupled through respective AND gates 31*a* to 31*d* to a memory 31 in the memory section 30. Note codes fed to the lines 23*a* to 23*l* are also coupled to the memory 31.

Data read out from the memory 31 are coupled through AND gates 31*e* to 31*h* to the other input terminals of the respective AND gates 25*e* and 25*h*. The AND gates 31*a* to 31*d* are on-off controlled by a control signal B coupled from the control section 40 to their other input terminals, and the AND gates 31*e* to 31*h* are on-off controlled by a control signal C coupled from the control section 40 to their other input terminals. The control signal C is also coupled to a read/write terminal R/W of the memory 31. An address increment signal D is further coupled to the memory 31 at the time of the reading operation thereof.

Figure 3:
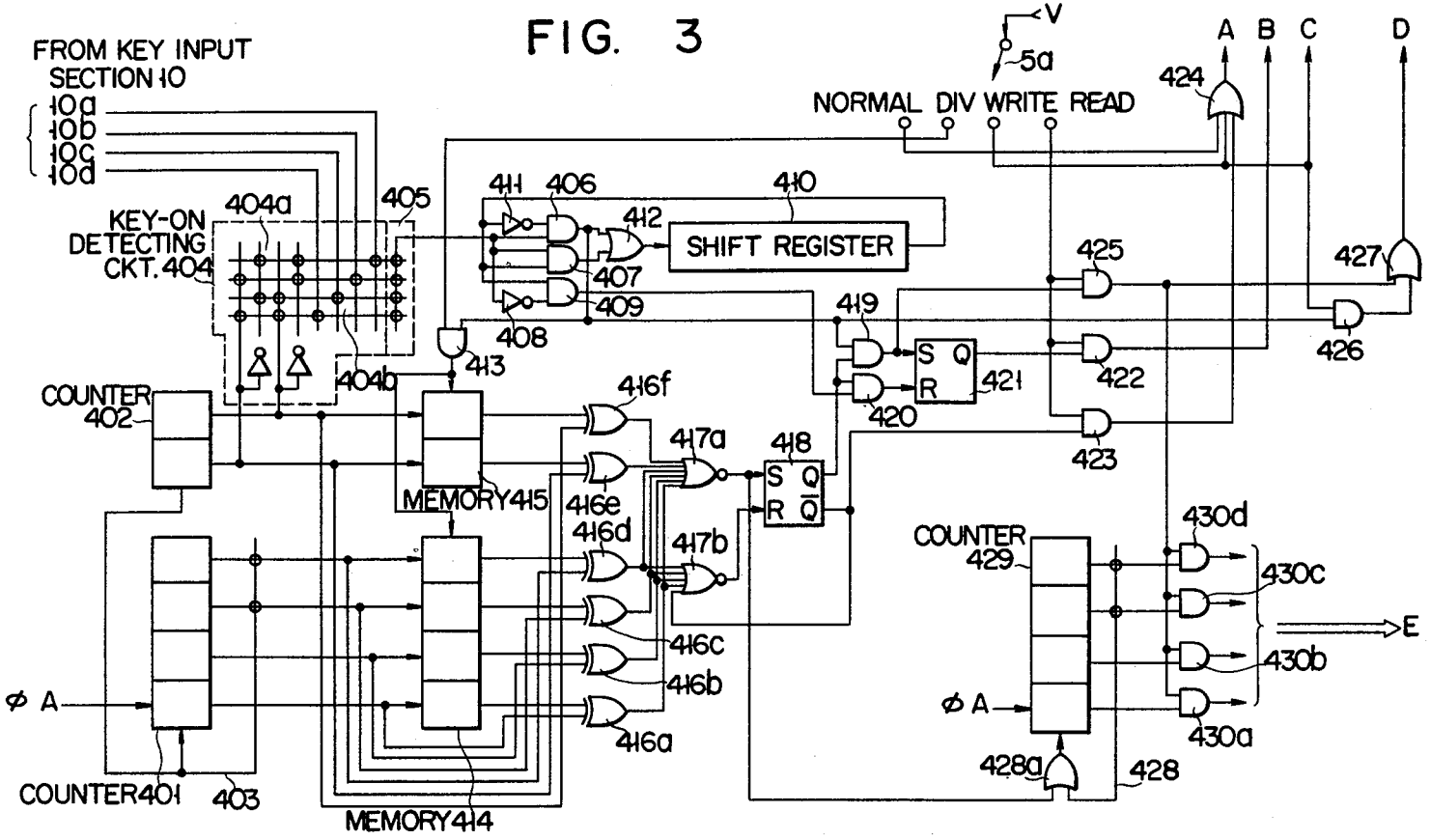
FIG. 3 is a schematic representation showing the detailed internal construction of a control section shown in FIG. 2B.

The control section 40 receives the output of the switch 5*a* shown in FIG. 1, the outputs on the lines 10*a* to 10*d* of the key input section 10 and the clock signal $\phi_A$ and produces a gate on-off control signal A coupled to the other input terminals of the AND gates 61*a* to 61*d* and the aforementioned volume control signal E coupled to the volume control circuit 52 as well as the control signals coupled to the memory 31. Its detailed construction is shown in FIG. 3. The input and output terminals shown in FIG. 3 do not coincide in position with those shown in FIGS. 2A and 2B.

In FIG. 3, designated at 401 is a counter operated in synchronism with the note counter 21 mentioned above, and at 402 a counter operated in synchronism with the block counter 22 mentioned above. To the first bit of the counter 401 is coupled the same clock signal $\phi_A$ as that coupled to the clock signal. The counter 401 is reset by a signal coupled to a line 403 when the count content in the counter 401 becomes "12". The signal coupled to the line 403 is also coupled as a counting clock signal to the counter 402. The output of the counter 402 is coupled to a key-on detecting circuit 404. The key-on detecting circuit 404 includes a decoder section 404*a*, which decodes the output of the counter 402 like the block decoder 24, an AND gate section 404*b*, which receives the key operation signals coupled to the lines 10*a* to 10*d* in the key input section 10 and the outputs of the decoder section 404*a* and produces AND signals from these inputs for the individual octaves like the AND gates 25*a* to 25*d*, and an OR gate section 405 receiving the outputs of the AND gate section 404*b*.

The output of the OR gate section 405 is directly coupled to AND gates 406 and 407 at one input terminal thereof is and also coupled through an inverter 408 to an AND gate 409 at one input terminal thereof. Coupled to the other input terminal of the AND gate 406 through an inverter 411 is the output of a shift register 410 having a capacity of 48 bits, and this output is also coupled directly to the other input terminals of the AND gates 407 and 409. When a new key operation is made, the key operation is continued and when the key operation is stopped, these AND gates 406, 407 and 409 respectively produce "1" signals at the timing of that key. The outputs of the AND gates 406 and 407 are coupled through an OR gate 412 to the shift register 410. The output of the AND gate 406 is coupled together with an output from a function division instruction terminal DIV of the switch 5a to an AND gate 413, and the output thereof is coupled as a write command signal to the memories 414 and 415 for memorizing the contents in the respective counters 401 and 402. The memories 414 and 415 memorize the positions of keys operated when the switch 5a is its function division instruction position DIV as note codes and block codes by reading the contents of the counters 401 and 402 which are synchronized to the note counter 21 and block counter 22 respectively. The outputs of the memories 414 and 415 are coupled together with the outputs of the respective counters 401 and 402 to exclusive OR gates 416a to 416f. When the contents of the note and block counters all coincide with the corresponding memory contents, a NOR gate 417a produces a "1" output which is coupled as a set signal to the set terminal S of an R-S flip-flop 418. To the reset terminal R of this R-S flip-flop is coupled the output of a NOR gate 417b, to which the outputs of the exclusive OR gates 416a to 416d and the output of the reset side output Q of this flip-flop are coupled. In this flip-flop 418, preference is given to the set side. This flip-flop 418 is held in a logic state "1" during the key scanning for one octave on the high pitch side of the keyboard 4 including the key, by which the function division is specified, while it is held in a logic state "0" during other key scanning.

The set side outputs Q of the R-S flip-flop 418 are coupled to AND gates 419 and 420 at one input terminal thereof. To the other input terminal of the AND gate 419 is coupled the output of the AND gate 406, and to the other input terminal of the AND gate 420 is coupled the output of the AND gate 409. The outputs of the AND gates 419 and 420 are respectively coupled to the set and reset terminals S and R of an R-S flip-flop 421. This flip-flop 421 is held in a logic state "1" while one of 12 keys for one octave of the keyboard 4 in function division is being operated.

The set side output Q of the flip-flop 421 is coupled to an AND gate 422 at one input terminal thereof, and to the other input terminal thereof is coupled the output from a read instruction terminal READ of the switch 5a for specifying the reading from the memory 31. The output of the AND gate 422 is coupled, as is the aforementioned control signal B, to the AND gates 31e to 31h.

The switch 5a further has a normal terminal NORMAL for specifying the normal performance and a write terminal WRITE for specifying the writing in the memory 31. The outputs from the terminals NORMAL and WRITE are coupled to an OR gate 424, to which the output of an AND gate 423 receiving the output from the read terminal READ of the memory 31 and the reset side output Q of the R-S flip-flop 418 is also coupled. The output of the OR gate 424 is coupled as the control signal A to the AND gates 61a to 61d.

Further, the output from the write terminal of the switch 5a specifying the writing in the memory 31 is coupled as the control signal C to the AND gates 31a to 31d and the read/write terminal R/W of the memory 31.

Further, the output of an AND gate 425, which receives the output of the read terminal READ of the switch 5a and the output of the AND gate 419, and the output of the AND gate 426, which receives the output of the write terminal WRITE of the switch 5a and the output of the AND gate 406, are coupled to an OR gate 427, and the output thereof is coupled as the address increment control signal D to the memory 31.

In addition to the control signals A to D, the volume control signal E is produced from the control section 40. More particularly, the output of the NOR gate 417a and output signal supplied from a 4-bit counter 429 to a line 428 when the content of the counter 429 becomes "12", are coupled as a reset signal through an OR gate 428a to the counter 429, which upcounts the clock signal $\phi_A$. The individual bit outputs of the counter 429 are coupled to respective AND gates 430a to 430d, which are on-off controlled by the output of the AND gate 425. The outputs of these AND gates 430a to 430d are coupled as a 4-bit volume control signal E to the volume control circuit 52 in the acoustic converter section 50. The volume control signal E is thus a 4-bit data, which changes in 12 steps from "0" to "11" to permit changes of the volume in steps, for instance from pp (pianissimo) to ff (fortissimo).

The use of the electronic instrument having the above construction will now be described using the highest octave keys of the 4-octave keyboard 4, i.e., the keys 4–37 to 4–48 for $C_5$ to $B_5$, as memorized melody performance content reading instruction keys for reading the content of the memory 31 with reference to FIGS. 4 and 5.

Figure 4:
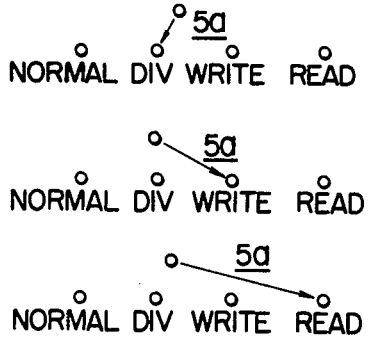
FIG. 4 shows three different switch positions of an operation mode selection switch.

The switch 5a is set to the function division instruction terminal DIV for specifying the function division, as shown in (a) in FIG. 4, and the key 4–37 for $C_5$ is operated. With the operation of the key 4–37 for $C_5$, an output appears on the line 10d of the key input section 10 at the timing for C and is coupled to the key-on detecting circuit 404 of the control section 40. The key-on detecting circuit 404 produces a "1" signal to a given line in the OR gate 405 when the content of the counter 402 becomes "3". As a result, a "1" signal is produced from the AND gate 406, causing the AND gate 413 to produce a "1" output, whereby the contents of the counters 401 and 402 are read out and written in the memories 414 and 415. Thus, during the key scanning, the R-S flip-flop 418 is given the "1" output as the set signal from the NOR gate 417a at the timing for $C_5$ and the reset signal from the NOR gate 417b at the timing for $C_2$ (as well as $C_3$ and $C_4$).

The process of storing melody data in the memory 31 is described hereinbelow. To this end, the switch 5a is set to the terminal WRITE for specifying the writing in the memory 31, as shown in (b) in FIG. 4, and given performance keys in the keyboard 4 are operated to write their pitch codes in the memory 31. At this time, the memory 31 is held in the write mode with the "on" signal C coupled to the AND gates 31a to 31d. By operating the key 4–32 for $G_4$ in the keyboard 4 for recording the first tone $G_4$ in a first part of a music piece as shown in (a) in FIG. 5, the output from this key is obtained in the line 10c at the timing for the note G and is coupled through the AND gate 31c to the memory 31. At this time, the signal appearing on the line 10c is coupled through the OR gate 405 at the timing peculiar to $G_4$. With the output from the OR gate 405 and the "1" output of the inverter 411, which is obtained since the bit for $G_4$ in the shift register 410 has not been "1", a "1" output is obtained from the AND gate 406. With the output from the AND gate 406 and the control signal C, the AND gate 426 produces the AND output which is coupled as address increment signal D through the OR gate 427 to the memory 31. Thus, the memory 31 reads out and memorizes the note codes output to the lines 23*a* to 23*l* and the block codes output to the AND gates 31*a* to 31*d*. The memory 31 counts the number of times when the note code for B is output to the lines 23*a* to 23*l*, and it memorizes codes coupled during the scanning of all the keys for $C_2$ to $B_5$ as those for sounds which are to be simultaneously produced. At this moment, however, it memorizes only the code for $G_4$. By operating the key 4–36 for $B_4$ next, the code for $B_4$ is memorized through the similar operation. In this way, by operating the keys for $D_5$, $B_4$, $D_5$, $E_5$, . . . in accordance with the score shown in (a) and (d) in FIG. 5, the musical melody note pattern shown in FIG. 5 is memorized in the memory 31.

The case of reading out and reproducing the performance content memorized in the above way using the right hand by considering only the rhythm pattern thereof while producing an accompaniment using the left hand is described hereinbelow. In this case, the switch 5*a* is set to the terminal READ for specifying the reading from the memory 31. With this setting and also the aforementioned setting of keys for function division, the R-S flip-flop 418 produces "1" output as its set side output Q at the key timing for $C_5$ to $B_5$ and produces "1" output as its reset side output Q at the key timing for $C_2$ to $B_4$. Thus, by operating a given key for a note among the notes $C_5$ to $B_6$ using the right hand, the output produced from the operated key is coupled through the OR gate 405 at the timing of that key, causing the AND gate 406 to produce a "1" signal since no "1" signal has been memorized in the shift register 410. Thus, the AND gate 406 produces the AND output to set the R-S flip-flop 421, causing the AND gate 422 to produce a "1" signal which is coupled as the "on" signal B to the AND gates 31*e* to 31*h*. At the same time, the AND gates 425 produce the AND output which is coupled as the increment signal D through the OR gate 427 to the memory 31. The memory 31 compares under the control of this command the note codes fed to the lines 23*a* to 23*l* of the note decoder 23 and the memorized note codes and, when a coincidence is detected, produces a "1" signal to a line corresponding to a stored block code. At this moment, the note memorized in the first place is $G_4$, and when the note code for G is fed to the lines 23*a* to 23*l*, the memory 31 produces an output to be coupled to the AND gate 25*g*. At the output of the AND gate 25*g*, a "1" signal is produced when the count content of the block counter 22 becomes "2", and it is coupled through the OR gate 26*b* to the shift register 27*b* to be written therein and then progressively shifted therethrough. With the subsequent appearance of an output from the AND gate 28*c*, i.e., at the end of the scanning of all the keys in the key input section 10, the signal coupled to the shift register 27*b* is written in the buffer memory register 28*b*, and the tone generating circuit 29*b* produces the tone signal for $G_4$ in accordance with the data written in the buffer memory register 28*b* and supplies it to the volume control circuit 52.

Meanwhile, with the appearance of the "1" signal from the NOR gate 417*a* at the timing of the key for $C_5$, the counter 429 is reset at that time and comes up with its content of "1", "2", . . . , "11" at the respective timings for $C_5$#, $D_5$, . . . , $B_5$. When one of the keys for $C_5$ to $B_5$ is operated by the right hand, the AND gate 419 produces a "1" signal to open the AND gate 425 and hence open the AND gates 430*a* to 430*d*. Thus, at the aforementioned timings the content of the counter 429 is coupled as the volume control signal E to the volume control circuit 52.

The volume control circuit 52 amplifies the tone signal for $G_4$ produced from the tone generating circuit 29*b* to a level corresponding to the volume control signal E, and its output is coupled through the amplifier 51 to the loudspeaker 6 for producing musical sound.

When the key among the keys for $C_5$ to $B_5$ that has been operated is released, the AND gate 409 produces a "1" signal, which is coupled as the reset signal through the AND gate 420 to the R-S flip-flop 421. Thus, the control signal B from the AND gate 422 vanishes to cause vanishment of the output signal for $G_4$.

Subsequently, the note $B_4$ memorized in the second place in the memory 31 is read out in a similar manner to that described above, and the corresponding tone signal is amplified to a level corresponding to the operated key in the volume control circuit 52. In this way, the second tone is produced.

The third note $D_6$ is similarly read out for reproduction by operating a desired one of the keys for $C_5$ to $B_5$, while at the same time the key 4–8 for $G_2$ is operated with the left hand. With the operation of this key, the output therefrom is obtained on the line 10*a* of the key input section 10. At this timing, the R-S flip-flop 418 is reset as mentioned earlier, so that the AND gate 423 produces the AND output to open the AND gates 61*a* to 61*d*. Thus, the aforementioned key operation output is coupled through the AND gate 61*a* to the AND gate 25*a*. Since the AND gate 25*a* has been receiving the octave detection signal coupled from the block decoder 24 through the line 24*a*, when the line 24*a* is selected, i.e., when the count content of the block counter 22 becomes "0", the key operation signal for $G_2$ is coupled through the AND gate 25*a* and OR gate 26*a* to the shift register 27*a* to be written therein and progressively shifted therethrough. At the appearance of an output from the AND gate 28*c*, the signal coupled to the shift register 27*a* is read out and written in the buffer memory 28*a*, and the tone generating circuit 29*a* produces the tone signal for $G_2$ according to the data written in the buffer memory 28*a* and supplies it to the amplifier 51.

At the same time, the tone signal for $D_5$ produced in the tone generating circuit 29*b* according to the data read out from the memory 31 is coupled through the volume control circuit 52 to the amplifier 51. Thus, the two tones, namely the melody tone $D_5$ and accompaniment tone $G_2$, are simultaneously produced.

Figure 5:
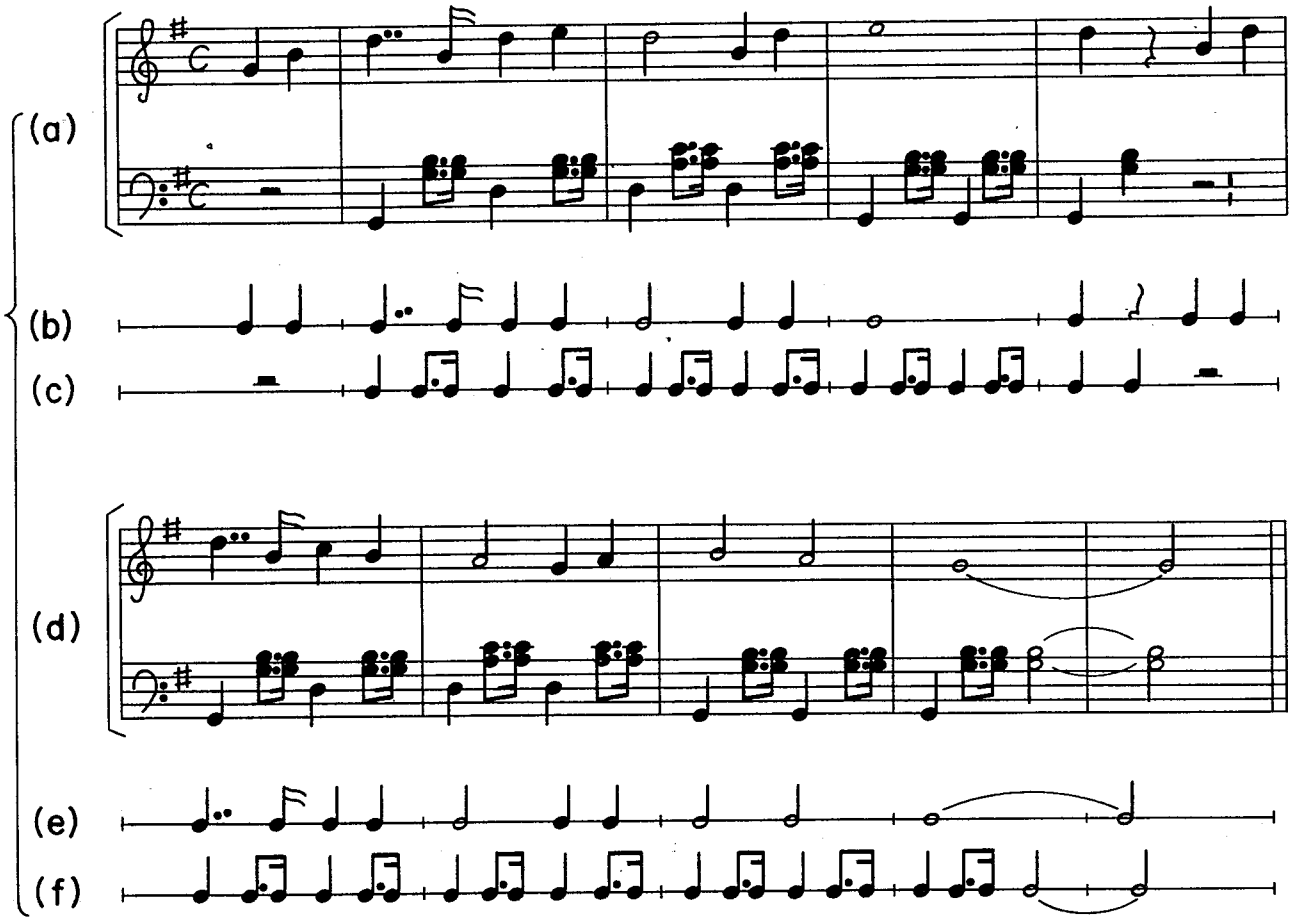
FIG. 5 is a view showing part of a score for illustrating the operation of the embodiments shown in FIGS. 1, 2A, 2B and 3.

In the above way, playing the instrument according to the accompaniment score as shown in (c) and (f) in FIG. 5 with the left hand and while operating a desired one of the keys for $C_5$ to $B_5$ in a rhythm pattern as shown in the rhythm score shown in (b) and (e) in FIG. 5, tones of the notes according to the score shown in (a) and (d) in FIG. 5 are successively produced in the tone generating circuit 29. Also, by selectively operating one of the keys 4–37 to 4–48, volume control of the melody tones is effected before the music sound is produced through the loudspeaker 6.

While in the above embodiment, the performance content of the melody score is written in the memory 31 and read out for reproduction, it is also possible to write and read the performance content of the accompaniment score. In this case, the keys for $C_2$ to $B_2$ may be used as the reading instruction keys and selectively operated according to the rhythm score as shown in (b) and (e) in FIG. 5 to produce sounds at desired levels while playing the instrument with the right hand according to the melody score as shown in (a) and (d) in FIG. 5. The operation in this case is substantially the same as described above, so that it is not described here.

Also, while in the above embodiment the function division of the keyboard 4 at a desired position can be specified, it is also possible to permit function division at a fixed position, for instance permit the keys $C_2$ to $B_2$ to be set as reading instruction keys. Further, while in the above embodiment keys for one octave are set as reading instruction keys and increasing levels are allotted for keys for increasing pitch tones, this is by no means limitative. For example, instead of the keys for one octave, six keys may be set as reading specification keys corresponding to respective six levels, namely pp (pianissimo), P (piano), mp (mezzo piano), mf (mezzoforte), f (forte) and ff (fortessimo). Also, instead of increasing levels, decreasing levels may be allotted for keys for increasing pitch tones.

Further, while in the above embodiment only a single memory 31 is provided in the memory section 30 for recording and reproducing either melody or accompaniment, it is possible to provide two memories for recording both melody and accompaniment and also permit them to be read out and reproduced by using respective two function division key groups with the volume level controlled in the order of arrangement of the keys in the two groups.

Further, though in the above-mentioned embodiment, a content of a musical piece is previously stored in the memory 31 through the operation of the performance keys, and the stored content is read out and reproduced by using a previously function set key in the keyboard 1, it is also possible, as shown in FIG. 2B, to transfer memory contents of a musical piece previously stored in an external memory device 30' such as magnetic card, magnetic tape, RAM (random access memory) package and a bar code memory into the memory 31 in the musical instrument and thereafter to read and reproduce the musical piece thus transferred by using a prescribed key in the keyboard.

A semiconductor memory like a RAM may be used to memorize a content of a musical piece for reproducing a musical piece through an operation of keys. Many kinds of other memories such as digital magnetic tapes and the like may also be used to memorize the content of a musical piece.

As has been described in the foregoing, the electronic instrument according to the invention permits a series of musical notes to be previously memorized and a musical piece to be read out using keys in part of the keyboard for reproduction under the volume level control in accordance with the order of arrangement of the keys, so that it is possible to play the instrument for producing even a considerably difficult piece for the beginner with simple operation with the memorized accompaniment or melody read out and reproduced according to the relevant rhythm pattern. This is very useful for the beginner. In addition, since the output volume level can be specified with the key operation, it is possible to obtain the same musical effects as in the case of an actual performance.

What is claimed is:

1. An electronic keyboard musical instrument comprising:

a keyboard having a plurality of multifunction performance keys;

memory means coupled to said keyboard and including means for previously storing a single series of note codes;

control means including function setting means for setting a function for predetermined multifunction performance keys on said keyboard as note code reading instruction keys for enabling reproducing of tones of the note codes previously stored in said memory means upon operation of said keys set as said note code reading instrumentation keys; and means coupled to said control means for setting different volume levels to reproduced tones as a function of the arrangement of the performance keys set as said tone code reading instruction keys.

2. An electronic keyboard musical instrument according to claim 1, wherein said memory means is connected to previously memorize a series of musical note codes obtained through operations of a plurality of performance keys on said keyboard.

3. An electronic keyboard musical instrument according to claim 1, comprising external input means coupled to said memory means to supply and previously store in said memory means a series of musical note codes from said external input means.

4. An electronic keyboard musical instrument according to claim 1, wherein said function setting means includes a function changing switch having a normal performance position and a readout/performance position and wherein, when said function changing switch is positioned at said normal performance position, said performance keys of said keyboard are adapted for a normal performance, and when said function changing switch is positioned at said readout/performance position, said plurality of performance keys are adapted for use as reading instruction keys of note codes previously stored in said memory means.

5. An electronic keyboard musical instrument according to claim 4, wherein said function changing switch further includes a keyboard division position, and said instrument further comprises:

division code memory means for memorizing a note code of an operated performance key when said function changing switch is set at said keyboard division position;

means for controlling the function of the operated performance keys to be set as normal performance keys or to be set as note code reading instruction keys when said function changing switch is at said readout/performance position; and said control means includes means for delivering a volume control signal in response to an operated performance key, when the operated performance key is set as a note code reading instruction key.

6. An electronic keyboard musical instrument according to claim 1, which further comprises:

means for producing a first tone signal according to a note code previously stored in said memory means;

means for producing a second tone signal according to the operation of a performance key in relation to said first one signal; and means for producing sounds corresponding to said first and second tone signals with the sound corresponding to said first tone signal under volume level control by said volume level setting means.

7. An electronic keyboard musical instrument comprising:

a keyboard having a plurality of multifunction performance keys;

memory means coupled to said keyboard and including means for previously storing a single series of note codes; and means coupled to said memory means for recalling previously stored note codes from said memory means responsive to operation of different performance keys, said different performance keys designating different volume levels when tones are reproduced from said singles series of note codes.

8. An electronic keyboard musical instrument according to claim 7, further comprising function setting means for selectively setting said instrument to a normal playing mode or a readout/performance mode, said performance keys on said keyboard being used for a normal performance when said normal playing mode is set, and said different performance keys being used as reading instruction keys of the note codes previously stored in said memory means when said readout/performance mode is set.

9. An electronic keyboard musical instrument according to claim 8, comprising means for dividing said performance keys on said keyboard into two key groups responsive to said readout/performance mode being set, keys of one key group being set as normal performance keys, and keys of the other key group being set as said different performance keys for reading out the note codes previously stored in said memory means (30) and to reproduce the tones having different volume levels.

10. An electronic keyboard musical instrument according to claim 9, wherein in a keyboard division mode said plurality of performance keys are divided into said two key groups with any arbitrary note as a boundary, said arbitrary note being designated by a performer; and in said readout/performance mode a musical performance may be carried by the performance keys of said two key groups.

* * * * *

UNITED STATES PATENT AND TRADEMARK OFFICE

CERTIFICATE OF CORRECTION

PATENT NO. : 4,361,067

DATED : November 30, 1982

INVENTOR(S) : Hiroshi ISHII

It is certified that error appears in the above-identified patent and that said Letters Patent is hereby corrected as shown below:

Column 10, line 11 (claim 1), "tone" should be --note--;

line 57 (claim 6), "one" should be --tone--;

Column 1, line 7, "a with keyboard" should be --with a keyboard--;

line 15, "a with keyboard" should be --with a keyboard--.

Column 10, line 7, "instrumentation" should be

-- instruction --.

Signed and Sealed this

*Twelfth* Day of *April 1983*

[SEAL]

*Attest:*

GERALD J. MOSSINGHOFF

*Attesting Officer*

*Commissioner of Patents and Trademarks*